United States Patent [19]

Marquis et al.

[11] 4,045,760

[45] Aug. 30, 1977

[54] CUT-BACK THERMOSTAT CONSTRUCTION

[75] Inventors: Edgar E. Marquis, Newtown; William A. Knecht, New Hartford, both of Conn.

[73] Assignee: Robertshaw Controls Company, Richmond, Va.

[21] Appl. No.: 644,599

[22] Filed: Dec. 29, 1975

[51] Int. Cl.[2] ..... H01H 37/62

[52] U.S. Cl. ..... 337/301; 337/305

[58] Field of Search ..... 337/301, 302, 303, 304, 337/305

[56] References Cited

U.S. PATENT DOCUMENTS

| | | | |
|---|---|---|---|
| 3,036,470 | 5/1962 | Houser et al. | 337/301 X |
| 3,825,872 | 7/1974 | Sadler et al. | 337/303 X |

FOREIGN PATENT DOCUMENTS

| | | | |
|---|---|---|---|
| 1,202,654 | 8/1970 | United Kingdom | 337/301 |

*Primary Examiner*—George Harris

*Attorney, Agent, or Firm*—Candor, Candor & Tassone

[57] ABSTRACT

A cut-back thermostat construction having a thermostat arrangement and a timer carried by a frame in such a manner that the timer will cut back the temperature setting of the thermostat arrangement by moving an electrical switch unit of the thermostat arrangement relative to a temperature responsive switch operator when a predetermined time is reached by the timer. A movable actuator is carried by the frame and is operatively associated with the switch unit to be adapted to cause a certain movement of the switch unit relative to the switch operator when the actuator is moved from a first position thereof to a second position thereof by the timer reaching the predetermined time. An adjustable member is carried by the frame and is separate from the actuator for selecting the amount of movement of the switch unit relative to the switch operator when the actuator is moved from the first position thereof to the second position thereof whereby the adjustable member selects the cut-back temperature of the thermostat arrangement.

20 Claims, 6 Drawing Figures

CUT-BACK THERMOSTAT CONSTRUCTION

This invention relates to an improved cut-back thermostat construction.

It is well known that cut-back thermostat constructions have been provided wherein each has timer means for causing the thermostat unit thereof to be automatically turned back to a lower temperature when the timer reaches a preselected time. For example, such cut-back thermostat construction can be set to cut back the thermostat setting thereof from its normal high temperature day-time setting to a low temperature night-time setting when the timer reaches a selected time period. Such thermostat construction can also then automatically reset the thermostat setting back to the day-time setting thereof when the timer subsequently reaches another predetermined time period thereof, such as in the morning. In this manner, a savings in energy use and cost will automatically result.

For example, see the co-pending patent application, Ser. No. 644,611, filed Dec. 29, 1975 of Werner R. Bauer for such a cut-back thermostat construction.

It is a feature of this invention to provide a cut-back thermostat construction of the above type having improved means for operating the thermostat arrangement by the timer means thereof.

In particular, one embodiment of the invention in the aforementioned co-pending patent application provides a cut-back thermostat construction having a thermostat arrangement and a timer means carried by a frame means in such a manner that the timer means will cut back the temperature setting of the thermostat arrangement by moving an electrical switch means of the thermostat arrangement relative to a temperature responsive switch operator of the thermostat arrangement when a predetermined time is reached by the timer means, a movable actuator means being carried by the frame means and being operatively associated with the switch means to be adapted to cause a certain movement of the switch relative to the switch operator when the actuator means is moved from a first position thereof to a second position thereof by the timer means when the predetermined time is reached by the timer means.

One embodiment of this invention provides such a cut-back thermostat construction and additionally provides an adjustable means carried by the frame means and being separate from the actuator means for selecting the amount of movement of the switch means relative to the switch operator when the actuator means is moved from the first position thereof to the second position thereof whereby the adjustable means of this invention selects the cut-back temperature of the thermostat arrangement independently of the actuator means.

Accordingly, it is an object of this invention to provide an improved cut-back thermostat construction having one or more of the novel features set fourth above or hereinafter shown or described.

Other objects, uses and advantages of this invention are apparent from a reading of this description which proceeds with reference to the accompanying drawings forming a part thereof and wherein.

Figure 1:
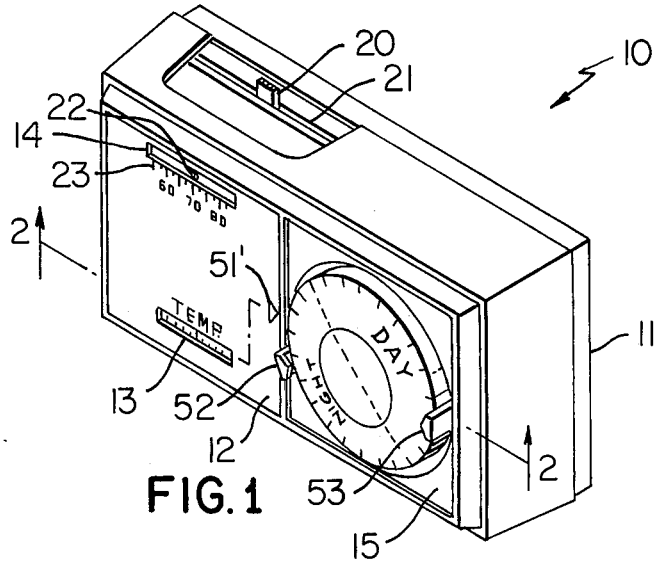
FIG. 1 is a front perspective view of the improved cut-back thermostat construction of this invention.

While the various features of this invention are hereinafter described and illustrated as being particularly adapted to provide the cut-back thermostat construction for operating a heat exchange unit for a building or residence, it is to be understood that the various features of this invention can be utilized singly or in any combination thereof to provide a cut-back thermostat construction for other apparatus as desired.

Therefore, this invention is not to be limited to only the embodiment illustrated in the drawings, because the drawings are merely utilized to illustrate one of the wide variety of uses of this invention.

Figure 2:
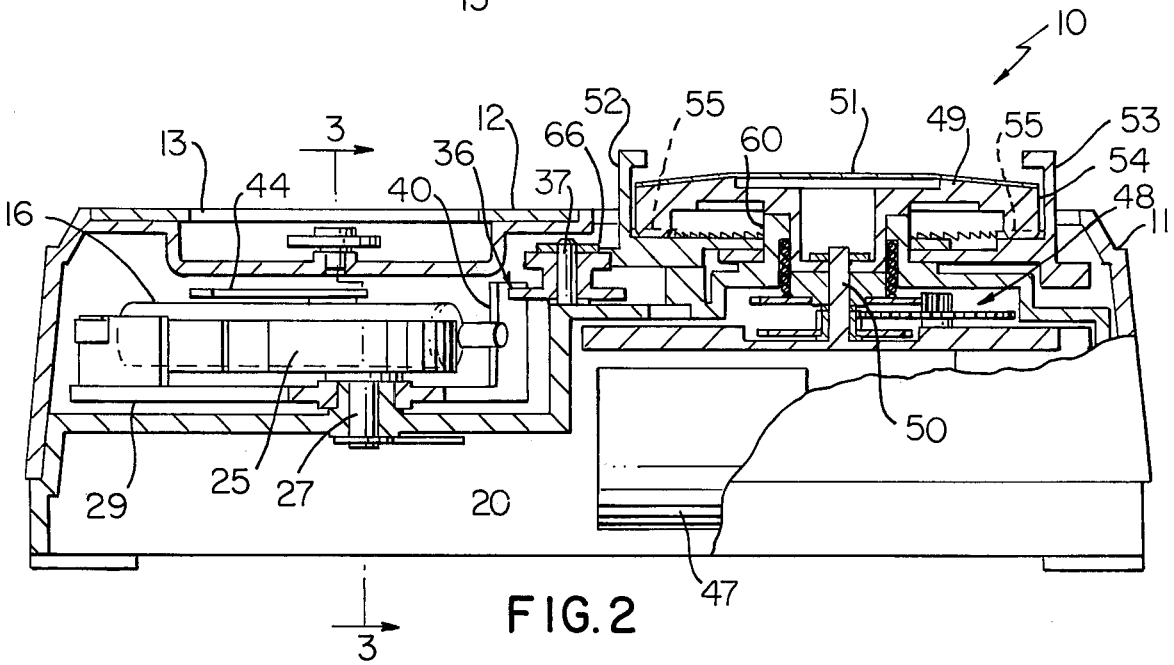
FIG. 2 is an enlarged cross-sectional view taken substantially on line 2—2 of FIG. 1.
Figure 3:
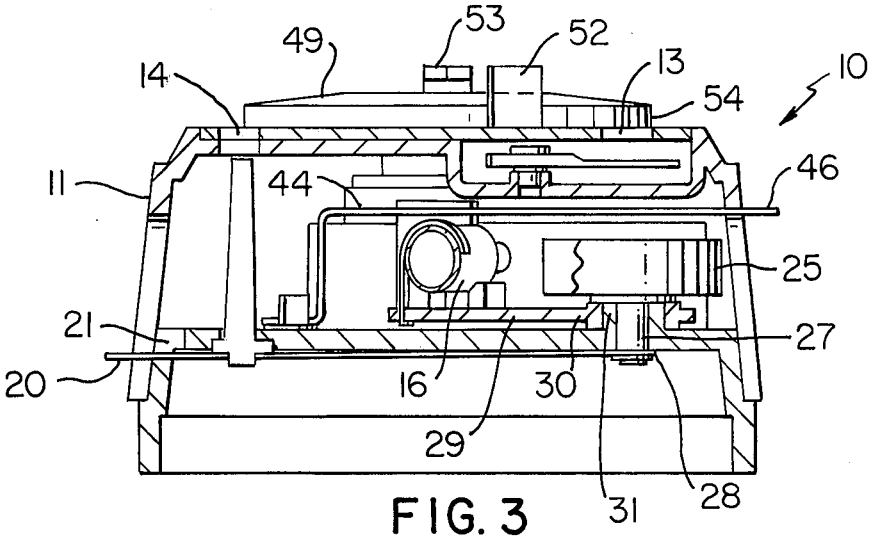
FIG. 3 is a cross-sectional view taken substantially on line 3—3 of FIG. 2.

Referring now to FIGS. 1, 2 and 3, the improved cut-back thermostat construction of this invention is generally indicated by the reference numeral 10 and comprises a frame means 11 carrying a front cover 12 and cooperating therewith to define a temperature indicating portion 13, a temperature setting portion 14 and a timer portion 15.

Figure 4:
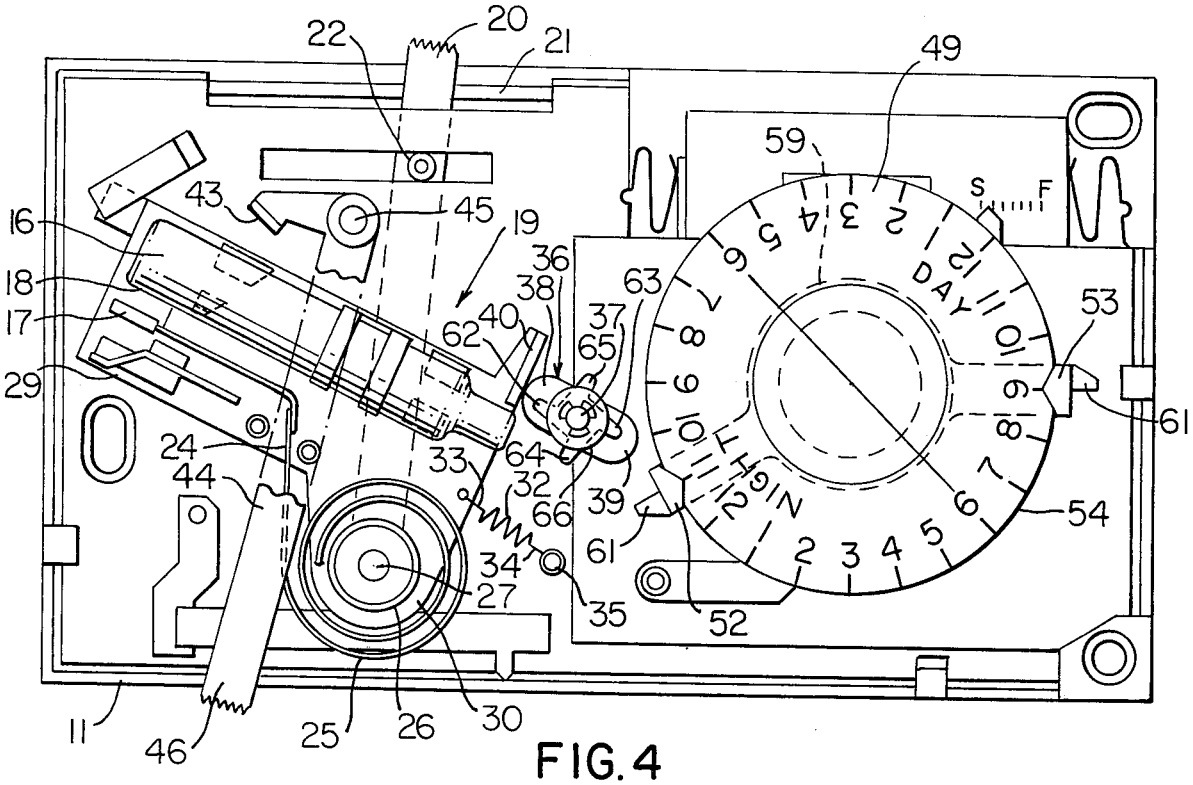
FIG. 4 is an enlarged front view of the cut-back thermostat construction of FIG. 1 with the front cover removed and certain pairs thereof broken away, the thermostat construction in FIG. 4 being shown in its day-time operating condition.

As illustrated in FIG. 4, a conventional magnet armature operated electrical switch construction 16 is carried by the frame means 11 in a manner hereinafter described and is adapted to be operated to a certain condition thereof when a magnet armature or switch operator 17 is moved closely adjacent or against the outer pierpheral part 18 thereof in a manner hereinafter described to turn on the heat exchange system (not shown) to tend to cause the same to have its output temperature effect increased to the temperature setting of a thermostat arrangement of the thermostat construction 10 that is generally indicated by the reference numeral 19 and which includes the switch construction 16 and magnet armature 17.

Figure 5:
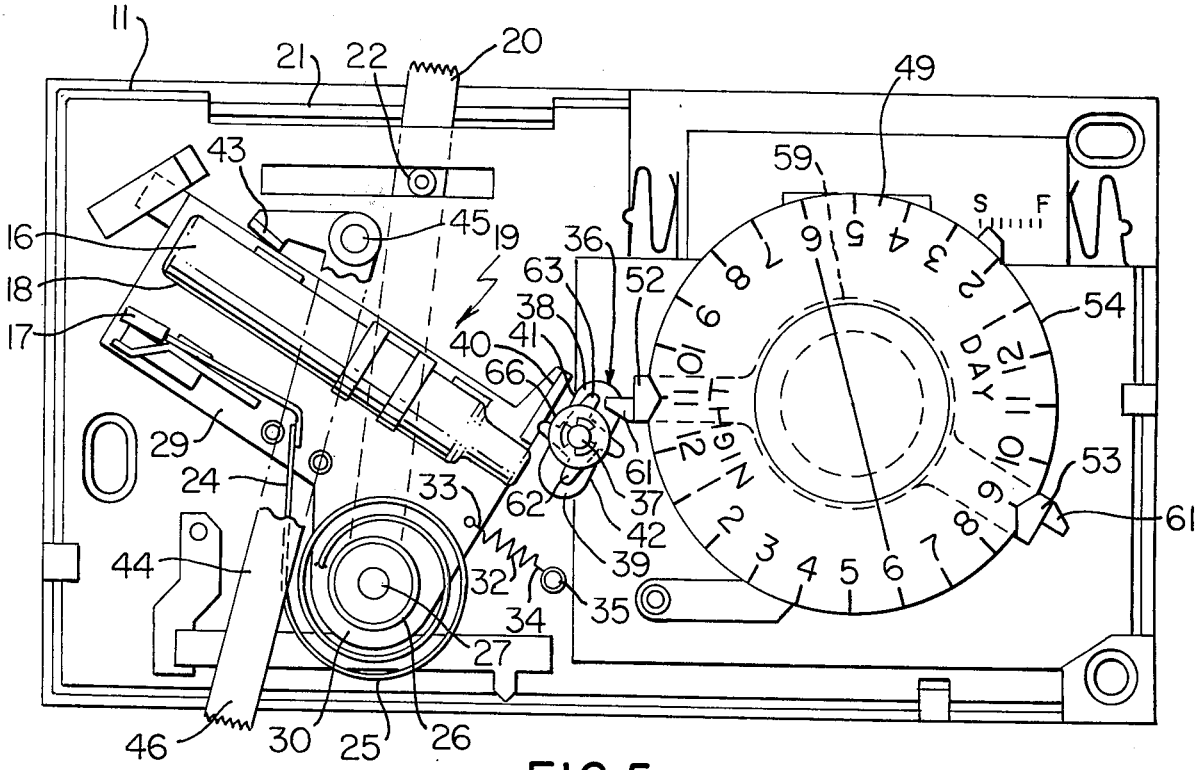
FIG. 5 is a view similar to FIG. 4 and illustrates the thermostat construction in its night-time condition.
Figure 6:
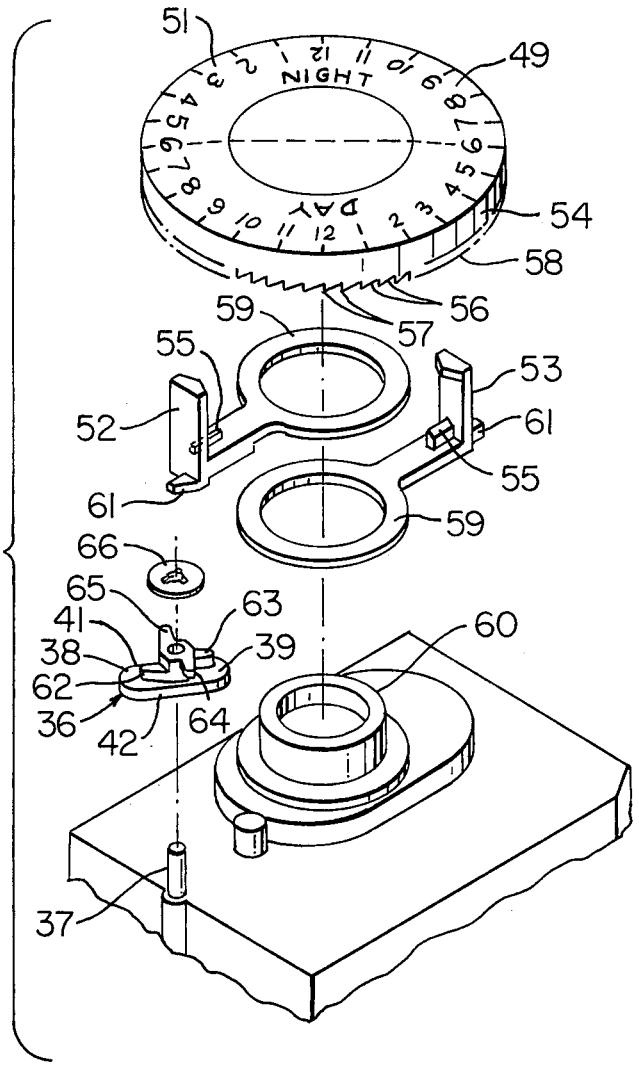
FIG. 6 is an exploded perspective view of certain parts of the timer means of the thermostat construction of FIG. 1.

When the magnet armature or switch operator 17 is moved away from the outer periphery 18 of the switch construction 16 a certain amount as illustrated in FIGS. 4 and 5, the switch construction 16 is operated to another condition thereof which turns off the heat exchange system.

In this manner, the thermostat construction 10 tends to maintain the output temperature effect of the heat exchange system at the temperature setting of the thermostat construction 10 as selected by a lever 20 which is movable in a slot 21 of the frame means 11 and positions an indicator post 22 thereof relative to a temperature scale 23 on the front cover 12 that forms the temperature setting portion 14 previously described.

The magnet armature 17 of the thermostat arrangement 19 is carried on the end 24 of a bimetal memeber 25 disposed in a spiral or coiled manner and having an inner end thereof secured to a sleeve 26 rotatably mounted to the frame means 11 by a shaft 27, FIGS. 2 and 3, adapted to be rotated by the lever 20 which has an inner end 28 fastened to the shaft 27.

In this manner, movement of the lever 20 causes rotational movement of the sleeve 26 and, thus, the temperature setting of the bimetal member 25 so that different temperatures will be required to cause the armature 17 to be moved against the switch construction 16 and operate the same to a condition to cause the heat exchange system to increase its output effect as will be apparent hereinafter.

The switch construction 16 is carried by a plate 29 that is rotatably or pivotally mounted to the frame means 11 by having a portion 30 thereof rotatably disposed about a sleeve portion 31 of the frame means 11 and that is concentric with the shaft 27 for the bimetal member 25 whereby the plate 29 is rotatable relative to the frame means 11 about the same axis of rotation as the axis of rotation of the bimetal member 25 as will be apparent hereinafter.

The plate 29 is normally biased to move in a clockwise direction about its sleeve 31 by a tension spring 32 having one end 33 fastened to the plate 29 and the other end 34 thereof fastened to a post means 35 of the frame means 11.

However, a rotatable and elongated actuator member 36 is rotatably carried on a post 37 of the frame means 11 and has opposed rounded ends 38 and 39 respectively adapted to engage against a flange 40 of the plate 29 in the manner illustrated in FIG. 4 to hold the plate 29 in a first rotational position relative to the frame means 11 that will provide normal day-time operation of the thermostat arrangement 19 as will be apparent hereinafter.

However, when the actuator member 36 is rotated 90°, as illustrated in FIG. 5, so that one of the narrow sides 41 or 42 thereof is facing the flange 40 of the plate 28, the force of the tension spring 32 is adapted to cause clockwise rotation of the plate 29 relative to the frame means 11 and toward the actuator member 36 until the same abuts against a stop end 43 of a second lever 44 that is pivotally mounted to the frame means 11 by a pivot means 45. At this time, the switch construction 16 has been moved relative to the armature 17 of the bimetal member 25 and thereby requires the bimetal member 25 to only operate the switch construction 16 when the output temperature effect of the heat exchange system has fallen below the normal setting of the lever 20 a certain amount as will be apparent hereinafter.

The lever 44 has a lower end 46 that extends out of the frame means 11 to permit the user to adjust the same relative thereto and thereby select the amount of cut-back temperature that the thermostat construction 10 is to be cut back at night-time as will be apparent hereinafter.

The thermostat construction 11 includes an electrically operated timer motor 47 carried by the frame means 11 and which through a suitable gear train arrangement, generally indicated by the reference numeral 48 in FIG. 2, will rotate a dial member 49 relative to the frame means 11, the dial 49 being rotatably mounted to the frame means 11 about a post 50 as illustrated and indicating the time of day.

In particular, the dial 49, on the upper surface 51 thereof, has a 24 hour indication thereon so the same rotates relative to the frame means 360° every 24 hours and indicates the time of day by its location relative to a stationary indicator arrow 51' on the front cover 12 as illustrated in FIG. 1.

A pair of adjustable tabs 52 and 53 are carried adjacent the outer periphery 54 of the dial member 49 and rotate in unison therewith by having abutments 55 thereof normally received in respective notches 56 between ratchet teeth 57 on the lower side 58 of the dial member 49 as illustrated in FIG. 2, the tabs 52 and 53 respectively having annular parts 59 telescoped about a cylindrical post 60 of the frame means 11 so the tabs 52 and 53 will rotate about the same axis of rotation as the axis of rotation of the dial member 49 as the dial member 49 is rotatably driven by the timer motor 47.

By pushing inwardly on the respective tab 52 or 53 to flex the respective tab away from the dial member 49, its abutment 55 will be freed from the notches 56 of the teeth 57 of the timer dial member 49 so that the particular tab 52 or 53 can be manually rotated relative thereto until the particular tab 52 or 53 is disposed adjacent the desired time on the face 51 of the dial 49. Thereafter, the pushed inwardly tab is released and the natural resiliency thereof forces its abutment 55 into a corresponding notch 56 of the dial member 49 so that the tab 52 or 53 will now be set in a new position relative to the dial 49 to rotate in unison therewith until reset manually in the manner previously described.

Each tab 52 and 53 has an outwardly directed extension or cam part 61 disposed in a different plane than the cam part 61 of the other tab 52 or 53 so that the cam 61 of the tab 52 is in a plane to engage only against either extension 62 or 63 of the rotatable actuator 36 as will be apparent hereinafter and the cam 61 of the tab 53 is adapted to engage only against either extension 64 or 65 of the rotatable actuator 36 as will be apparent hereinafter.

The rotatable actuator 36 is held for rotational movement on the post 37 of the frame means 11 by a retaining washer 66 as illustrated.

From the above, it can be seen that the thermostat construction 10 of this invention can be made of relatively few parts to operate in a unique manner now to be described.

The operator of the thermostat construction 10 sets the tab 52 to the desired setting relative to the dial 49 in the manner previously described when it is desired for the thermostat construction 10 to cut-back the operating temperature for the heat exchange system. In the example illustrated in the drawings, the tab 52 is set for causing temperature cut-back at 11:00 P.M.

Similarly, the tab 53 is set at the desired time for having the thermostat construction 10 begin to operate the heat exchange system at the desired day-time operating temperature thereof. In the example illustrated in the drawings, the tab 53 is set for causing normal or day-time operation of the heat exchange system beginning at 9:00 A.M.

The operator also sets the lever 20 to the desired temperature setting for day-time operation, such as 70° F and sets the lever 46 for the desired night-time operating temperature, which may be expressed in a number of degrees below the temperature setting of the lever 20. Thus, the lever 46 may be set from anywhere between 0° and −20° below the setting of the lever 20. Accordingly, should the lever 46 be set for −5° for night-time operation, the thermostat construction would be set for 65° F for night-time temperature in the above example.

During day-time operation of the thus set thermostat construction 10, the actuator member 36 is in the first rotational position of FIG. 4 wherein either end 38 or 39 thereof is disposed against the flange 40 of the plate 29 to hold the plate 29 in the rotational position illustrated in FIG. 4 whereby the switch construction 16 is positioned closely adjacent the end 24 of the bimetal member 25 so that the bimetal member 24 will tend to maintain the heat exchange output effect at the temperature setting of the lever 20. In particular, should the output temperature effect fall below the setting of the lever 20, the bimetal member 25 moves the armature 17 against the switch construction 16 to cause the switch construction 16 to turn on the heat exchange system to increase the output temperature effect thereof. When the output temperature effect of the heat exchange system exceeds the setting of the lever 20, the bimetal member 25 moves the armature 17 away from the switch construction 16 to cause the switch construction 16 to turn off the heat exchange system.

In this manner, the heat exchange system is cycled on and off by the temperature sensing bimetal member 25 to tend to maintain the output temperature effect thereof of the heat exchange system at the temperature setting of the lever 20.

However, when the timer dial member 49 reaches the 11:00 P.M. position thereof, the tab 52 has its cam extension 61 engaged against one of the extensions 62 or 63 of the actuator member 36 and will rotate to the same 90° as the timer dial member 49 continues to rotate in the manner illustrated in FIG. 5 whereby the end 38 or 39 of the actuating member 36 is moved away from the flange 40 of the plate 29 so that the force of the tension spring 32 can now cause the plate 29 to pivot in a clockwise direction as illustrated in FIG. 5 until the same engages against the end 43 of the lever 46. Thus, if the lever 46 is set for a 5° decrease in the temperature setting of the thermostat construction 10, the plate 29 will have rotated a certain amount so that the bimetal member 25 will only cause the switch construction 16 to turn on the heat exchange system when the output temperature effect thereof as fallen to approximately 5° below the setting of the lever 20 whereby the bimetal member 25 in the new position of the switch construction 16 will tend to maintain the output temperature effect of the heat exchange system at the cut-back temperature as set by the lever 46.

Thus, the thermostat construction 10 maintains the output temperature effect of the heat exchange system at approximately 65° F in the above example until 9:00 A.M. when the tab 53 of the timer dial 49 has its cam 61 engaged against one of its extensions 64 or 65 of the actuator member 36 to cause the same to rotate 90° from the position illustrated in FIG. 5 back to the position illustrated in FIG. 4. Thus, one end 39 or 38 of the rotatable actuator 36 now cams against the flange 40 of the plate 29 to rotate the plate 29 back in a counterclockwise direction to the position illustrated in FIG. 4 in opposition to the force of the tension spring 32 whereby the thermostat arrangement 19 will now maintain the output temperature effect of the heat exchange means at the actual setting of the lever 20 as previously described.

Thus, it can be seen that the tabs 52 and 53 of the timer dial member 49 each causes the actuator member 36 to rotate 90° when the same engages against one of its respective extensions thereof to thereby cause either a cut back in the temperature setting of the thermostat construction 10 or a return to the normal temperature setting thereof as previously described.

Accordingly, it can be seen that the thermostat construction 10 of this invention will automatically cause the actuator member 36 to rotate 90° each time the tab 52 or 53 engages the same so that the actuator 36, in effect, rotates 360° every 48 hours while the timer dial 49 rotates 360° each 24 hours.

From the above, it can be seen that the thermostat construction 10 of this invention is adapted to automatically cut back the thermostat setting of the thermostat arrangement 19 thereof from its normal day-time setting to a night-time setting and then automatically return the setting of the thermostat arrangement 19 back to its day-time setting at predetermined times as selected by the tabs 52 and 53 in the manner previously described.

Thus, this invention provides an improved cut back thermostat construction having many novel and unique features.

While the form of the invention now preferred has been illustrated and described as required by the Patent Statute, it is to be understood that other forms can be utilized and still fall within the scope of the appended claims.

What is claimed is:

1. In a cut-back thermostat construction having a thermostat arrangement and a timer means carried by a frame means in such a manner that said timer means will cut-back the temperature setting of said thermostat arrangement by moving an electrical switch means of said thermostat arrangement relative to a temperature responsive switch operator of said thermostat arrangement when a predetermined time is reached by said timer means, said construction also having movable actuator means that is carried by said frame means and is operatively associated with said switch means to be adapted to cause a certain movement of said switch means relative to said switch operator when said actuator means is moved from a first position thereof to a second position thereof by said timer means when said predetermined time is reached by said timer means, the improvement comprising adjustable means carried by said frame means and being separate from said actuator means for selecting the amount of movement of said switch means relative to said switch operator when said actuator means is moved from said first position thereof to said second position thereof whereby said adjustable means selects the cut-back temperature of said thermostat arrangement.

2. In a cut-back thermostat construction as set forth in claim 1, biasing means being interconnected to said switch means to normally tend to move said switch means to its greatest cut-back temperature position relative to said switch operator.

3. In a cut-back thermostat construction as set forth in claim 2, said actuator means being engageable with said switch means to hold said switch means in its least cut-back temperature position relative to said switch operator in opposition to the force of said biasing means when said actuator means is in said first position thereof.

4. In a cut-back thermostat construction as set forth in claim 3, said adjustable means comprising a movable member that is adapted to be positioned in the path of movement of said switch means to limit the movement of said switch means from its said least cut-back temperature position to a desired cut-back temperature position thereof.

5. In a cut-back thermostat construction as set forth in claim 4, said movable member comprising a lever pivotally mounted to said frame means and having one end thereof adapted to be positioned in said path of movement of said switch means.

6. In a cut-back thermostat construction as set forth in claim 3, said switch means being pivotally mounted to said frame means.

7. In a cut-back thermostat construction as set forth in claim 3, said actuator means comprising an actuator member rotatably carried by said frame means and having an abutment thereon for engaging and holding said switch means in its said least cut-back temperature position when said actuator member is in a first rotatable position relative to said frame means.

8. In a cut-back thermostat construction as set forth in claim 7, said actuator member having a non-abutment portion thereof facing said switch means when said actuator member is in a second rotatable position relative to said frame means.

9. In a cut-back thermostat construction as set forth in claim 8, said actuator member comprising an elongated member having rounded opposed ends one of which comprises said abutment.

10. In a cut-back thermostat construction as set forth in claim 8, said actuator member having a plurality of extensions, said timer means having means for serially engaging said extensions to cause rotation of said actuator member between and rotational positions thereof.

11. In a cut-back thermostat construction as set forth in claim 1, said timer means having cut-back means for engaging and moving said actuator means from said first position thereof to said second position thereof when said predetermined time is reached by said timer means.

12. In a cut-back thermostat construction as set forth in claim 11, said timer means including a rotatable time indicating dial, said cut-back means being carried by said dial.

13. In a cut-back thermostat construction as set forth in claim 12, said cut-back means being adjustably carried by said dial to be set in different time positions therewith for selecting the desired predetermined time for cutting back said thermostat arrangement.

14. In a cut-back thermostat construction as set forth in claim 13, said cut-back means comprising an adjustable tab carried by said dial and extending outwardly from the outer periphery of said dial.

15. In a cut-back thermostat construction as set forth in claim 11, said timer means having return-means for engaging and moving said actuator means from said second position thereof back to said first position thereof when another predetermined time is subsequently reached by said timer means whereby the temperature setting of said thermostat arrangement is returned to its normal setting.

16. In a cut-back thermostat construction as set forth in claim 14, said time indicating dial having an axis of rotation, said adjustable tab also being rotatable about said axis of rotation of said dial.

17. In a cut-back thermostat construction as set forth in claim 1, said switch means comprising a plate pivotally carried by said frame means and an electrical switch construction carried by said plate.

18. In a cut-back thermostat construction as set forth in claim 17, said temperature responsive switch operator comprising a bimetal member adjustably carried by said frame means.

19. In a cut-back thermostat construction as set forth in claim 18, said bimetal member having a coiled portion disposed for adjustment about an axis of rotation for temperature setting purposes.

20. In a cut-back thermostat construction as set forth in claim 19, said plate being pivotally mounted to same frame means about the same axis of rotation as said axis of rotation of said bimetal member.

* * * * *